US005693381A

United States Patent [19]

Cheng

[11] Patent Number: 5,693,381

[45] Date of Patent: Dec. 2, 1997

[54] BOW WITH POP-OUT DECORATIONS

[76] Inventor: Peter S. C. Cheng, 99 Glencairn Ave., Toronto, Ontario, Canada, M4R 1M7

[21] Appl. No.: 692,021

[22] Filed: Aug. 2, 1996

[51] Int. Cl.[6] ..... D04D 7/10

[52] U.S. Cl. ..... 428/5; 28/147; 223/46; 428/101

[58] Field of Search ..... 428/4, 5, 101; 28/147; 223/46

[56] References Cited

U.S. PATENT DOCUMENTS 3,632,464 1/1972 Grikis ..... 428/4

4,515,837 5/1985 Cheng ..... 428/4

5,198,274 3/1993 Etzion ..... 428/5

5,545,486 8/1996 Asano et al. ..... 428/5 X

*Primary Examiner*—Henry F. Epstein

*Attorney, Agent, or Firm*—Kirchstein et al.

[57] ABSTRACT

A plurality of pop-out decorations are die-cut from ribbon loops arranged in a bow. As the loops are formed, a part of each decoration is moved outwardly to create a multi-dimensional, multi-colored visual effect.

18 Claims, 2 Drawing Sheets

BOW WITH POP-OUT DECORATIONS

BACKGROUND OF THE INVENTION

1. Field of the Invention

The present invention generally relates to decorative bows to be applied to wrapped gifts and, more particularly, to pop-out decorations on such bows.

2. Description of the Related Art

It is known to provide fully assembled, pre-formed, pom-pon-like bows made of ribbons having folded arcuate loops arranged in a rosette pattern, as well as pull bows that utilize drawstrings to draw a ribbon into a number of arcuate loops, for application to wrapped gifts for ornamental purposes. See, for example, my U.S. Pat. No. 4,515,837 for a pull bow arrangement that automatically arranges the loops in an angularly spaced rosette or pom-pon-like form upon pulling a drawstring.

As advantageous as this arrangement may be, experience with it has shown that it still leaves something to be desired as far as the appearance of the bow in its final or finished form is concerned. More particularly, it was established that the external surfaces of the loops of the resulting bow are relatively plain or unornamented, that is, while there is obtained automatic distribution of the loops about the axis of the drawstring, the plain nature of the external surfaces of the loops left bows of this type at somewhat a disadvantage as far as their eye-catching appeal is concerned relative to other adorning articles that possessed more visual interest.

Another drawback encountered in this context is that, no matter how attractive the internal surfaces of the ribbon loops may be, especially in combination or contrast with the external ribbon loop surfaces, and how desirable it would therefore be to let them appear, they are hardly ever seen or noticed by observers in such prior art bows, unless the person making the bow cares enough about its appearance to go through the rather laborious and time-consuming procedure of turning at least the top loops at least partially inside out; even then, though, success is not assured, especially since there is nothing preventing the thus turned segments to revert to their original or natural positions.

OBJECTS OF THE INVENTION

Accordingly, it is a general object of the present invention to avoid the disadvantages of the prior art.

More particularly, it is an object of the present invention to provide an adorning article or decorative bow in the form of a pom-pon that does not possess the drawbacks of the known articles of this type.

Still another object of the present invention is to devise an adorning article of the type here under consideration which has an eye-catching appearance of high visual appeal.

It is yet another object of the present invention to design the above adorning article in such a manner as to give it a much fuller, three-dimensional appearance in its finished form.

A still further object of the present invention is to develop an adorning article of the above type in which interior surfaces below at least some of the loops are being given much more prominence in the final state of the article than ever before in non-preformed adorning articles.

A concomitant object of the present invention is so to construct the adorning article of the above type as to be relatively simple in construction, inexpensive to manufacture, easy to use, and yet reliable in operation.

SUMMARY OF THE INVENTION

In keeping with the above objects and others which will become apparent hereafter, one feature of the present invention resides in a decorative bow, comprising a plurality of ribbon loops, and a pop-out decoration integral with, and partially separated from, at least one of the ribbon loops. The decoration has a fixed part attached to the one ribbon loop, and a raised part spaced outwardly from the one ribbon loop. The loops are preferably equiangularly arranged about an upright central axis.

In the preferred embodiment, a pop-out decoration is provided centrally on each ribbon loop across a bight portion of the respective ribbon loop. Each decoration is die-cut or stamped from the ribbon loop and is severed therefrom except at a pair of webs which constitute the fixed part. The decoration may have any desired shape, such as a star or a heart, just to mention two possibilities.

In an especially advantageous construction, the bow is formed as a pull bow with a pair of interconnected ribbon members, and a drawstring operative to fold the ribbon members into loops. As the drawstring is pulled, foldable ribbon segments on each ribbon member are folded into the loops and, at the same time, the raised part of each decoration moves from an initial position in which the raised part is generally co-planar with the respective ribbon loop, to a final raised position in which the raised part is spaced from the respective ribbon loop.

The resulting completed bow is thus provided with a unique, three-dimensional appearance in which the decorations appear to "pop-out" of the bow.

For greater visual effect, strips of contrasting color or texture underlie the ribbon members. Their color/texture contrast is visible through the space bounded by the raised part of each decoration and the respective ribbon loop. This increases the visual appeal of the bow.

The novel features which are considered as characteristic of the invention are set forth in particular in the appended claims. The invention itself, however, both as to its construction and its method of operation, together with additional objects and advantages thereof, will be best understood from the following description of specific embodiments when read in connection with the accompanying drawings.

DETAILED DESCRIPTION OF THE PREFERRED EMBODIMENTS

Figure 1:
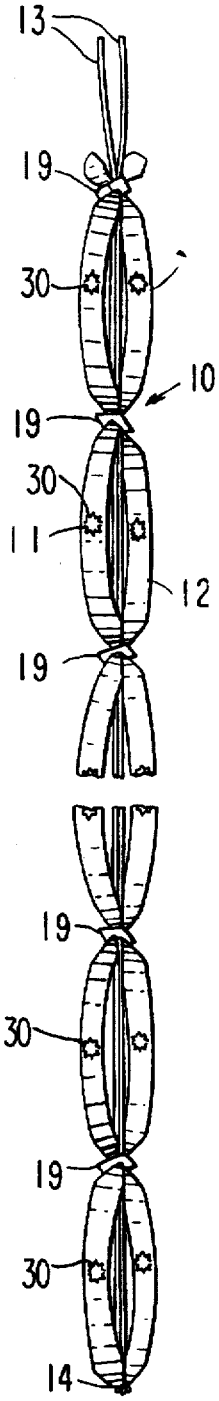
FIG. 1 shows a bow-forming ribbon in accordance with one embodiment of the invention.

Referring now to the drawings, FIG. 1 shows two ribbon members 11 and 12 disposed in a face-to-face relationship. The members 11 and 12 are formed by taking a length of conventional decorative ribbon material, e.g., a conventional synthetic plastic having a satin-like fibrous texture, and folding it at its middle 14. A drawstring 13, which may be formed of a narrower width of the material of the members 11 and 12 is connected to the members 11 and 12, and passes between the two members 11 and 12.

In the example illustrated, the drawstring 13 is a double length of material which is tied in a knot at its middle around the middle portion 14 of the folded-over ribbon members 11 and 12. Although in the example illustrated the ribbon is formed from two ribbon members 11 and 12 and a double length of the drawstring material 13 is provided, as will be appreciated, the ribbon may instead comprise only a single length of the ribbon material 11, and only a single drawstring 13 may be provided, attached to the single ribbon member 11 at one end.

Figure 2:
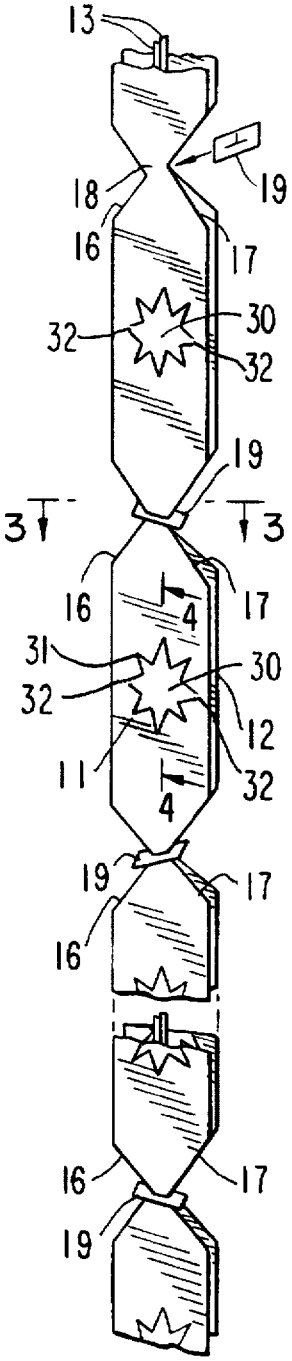
FIG. 2 shows a partially fragmentary view of the ribbon of FIG. 1 on an enlarged scale, and illustrating the method of assembly of the ribbon.

As best seen in FIG. 2, each ribbon member 11 and 12 is formed into a series of segments, preferably of approximately uniform length, by V-shaped indentations 16 and 17 cut on opposite sides of the ribbon members.

The indentations 16 and 17 are offset longitudinally from one another on opposite edges of the ribbon members 11 and 12 so that a narrow neck portion 18 is formed between each indentation which has its narrowest portion inclining at a small angle, e.g., about 30° to 40°, with respect to the transverse width of the ribbon members 11 and 12. The successive pairs of indentations 16 and 17 are formed so that each neck portion 18 inclines at an angle different from that of the preceding neck portion. In the preferred form, as shown in FIG. 2, the angle of inclination of each neck portion 18 is equal, but each inclines in a direction opposite to that of the preceding neck portion 18.

A retainer member 19 is applied around each neck portion 18. Each retainer member comprises a small piece of a sheet material which is relatively stiff compared to the ribbon members 11 and 12. The retainer member may, for example, comprise a piece of thin and stiff plastic material, e.g., a cellulose plastic material. The retainer member 19 is provided with a central aperture 21 of a width to receive the narrow neck portions 18 of the ribbon members 11 and 12 and the drawstring members 13, the latter being received sufficiently loosely so that they can be pulled relatively freely between the neck portions 18. The retainer member 19 is formed with a cut 22 extending inwardly from one edge to the aperture 21. The retainer member 19 is applied by flexing it slightly to open the cut portion 22, so that the neck portions 18 and the drawstring members 13 can be introduced into the aperture 21.

Figure 3:
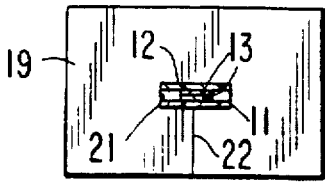
FIG. 3 shows a cross-section on an enlarged scale taken on the line 3—3 in FIG. 2.
Figure 4:
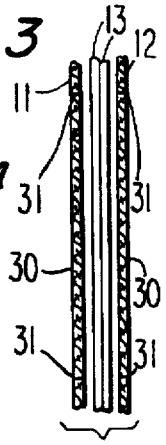
FIG. 4 shows a cross-section on an enlarged scale taken on the line 4—4 in FIG. 2.

As seen in FIG. 3, the neck portions 18 are received snugly in the aperture 21, so that the retainer member 19 is retained against movement longitudinally relative to the ribbon members 11 and 12, and adopts and maintains the orientation of the narrow neck portion 18. Each retainer member 19 is thus inclined at the same angle as the narrow neck portion 18, and is in the form of a small plate presenting planar front and rear faces extending generally perpendicularly of the plane of the ribbon members 11 and 12, these faces being inclined with respect to the transverse width of the ribbon members 11 and 12 and, in the example shown, each retainer member 19 being inclined in a direction opposite from that of the preceding retainer member 19.

As will be appreciated, in order to locate the retainer members 19 relative to the ribbon members 11 and 12, and to orient them at the desired angles, it is not necessary to provide indentations of the V-shape illustrated. For example, a simple cut may be formed inwardly from each edge of the ribbon member, the cuts being offset to provide a narrow land or intervening portion around which the retainer member 19 may be clipped.

As described so far, the pull bow arrangement is essentially identical to that described in my U.S. Pat. No. 4,515,837. In accordance with the present invention, at least one pop-out decoration 30, and preferably a plurality of pop-out decorations 30, is provided on at least one, and preferably both, of the ribbon members 11 and 12. Each pop-out decoration 30 is advantageously partially die-cut from a respective ribbon member.

In FIG. 2, the decoration 30 has a star-like pattern. The decoration is separated from the respective ribbon member along its entire periphery along a peripheral cut 31, except at a pair of spaced-apart webs 32 located at opposite sides of the decoration. The webs 32 are attached to, and of one-piece with, the respective ribbon member.

In use, the ribbon in the flat form illustrated in FIGS. 1 and 2 is converted into a decorative pom-pon or rosette-like bow by grasping the free ends of the drawstrings 13 in one hand, and retaining a portion of the drawstrings 13 adjacent the retainer member 19 adjacent the free ends 13 lightly between the finger and thumb of the other hand. The drawstrings 13 are then pulled outwardly, with the finger and thumb engaging the underside of the retainer member 19, so that the segments of the ribbon members 11 and 12 between the indentations 16 and 17 are gathered up into loops 24.

Figure 5:
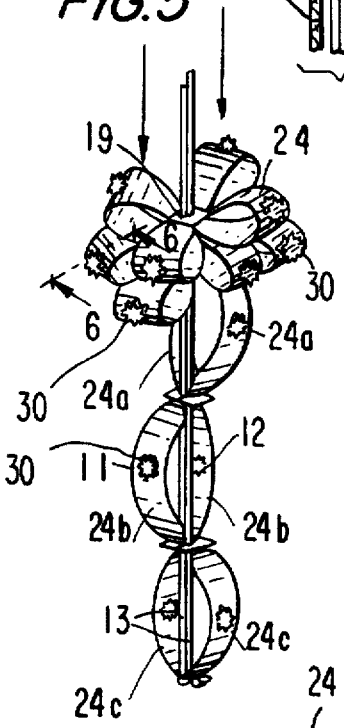
FIG. 5 illustrates the procedure of forming the ribbon into a bow.

Because of the angled orientation of the retainer members 19, these tend to seat themselves on the bow loops, for example the bow loops 24*a*, 24*b* and 24*c* in FIG. 5, at angularly skewed orientations. Thus, the successive loops 24*a*, 24*b* and 24*c* tend to be skewed angularly relative to one another at differing angles around the axis of the drawstrings 13 so that, instead of the loops 24 tending to superimpose themselves one on the other, the successive loops become arranged at differing angles spaced around the axis of the drawstrings 13 so that a bow is formed with the loops 24 arranged at varying angles around the axis of the drawstrings 13, to provide a desired attractive rosette or pom-pon-like form.

Figure 6:
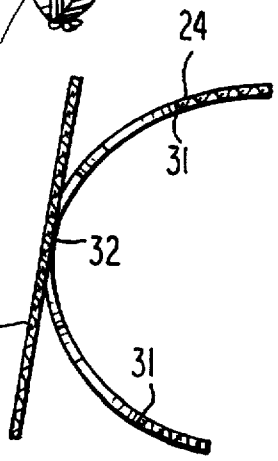
FIG. 6 shows a cross-section on an enlarged scale taken on the line 6—6 in FIG. 5.

During the formation of the loops 24, each decoration 30, which was initially co-planar with its associated loop segment (see FIG. 2), is moved relative to the respective loop segment. Preferably, each decoration 30 is centrally located on each ribbon segment so that, as shown in FIG. 6, the decoration lies across the bight portion or fold of the loop segment. The webs 32 retain the sides of the decoration in place, but the remainder of the decoration is spaced outwardly from the respective loop segment.

Once the bow is formed, the drawstrings 13 may be knotted adjacent the retainer member 19 exposed on the underside of the completed bow, and the free ends of the drawstrings 13 may be cut off. Alternatively, the drawstrings may be used for tying a parcel, and may thus secure the completed bow in position around a parcel or the like to be decorated by the bow.

The formed bow has thus been imparted with a unique "starburst" appearance wherein a plurality of stars appear to be raised above the rosette bow, akin to shooting stars. The resultant three-dimensional look is visually appealing.

The bow-forming ribbon may be provided to users with an adhesive-backed card having an aperture through which the free ends of the drawstrings 13 are threaded. The adhesive-coated surface may normally be covered by a release paper which is removed after forming the bow in order to assist in securing the completed bow to a parcel or the like.

As will be appreciated, the bow-forming ribbon as illustrated may be packed flat for storage and transport. The ribbon may, for example, be folded about the narrow or neck portions 18, with the segments of the ribbon being folded one on another, to provide a compact, folded structure.

Turning now to the embodiment of FIGS. 7–10, the implementation is similar to that described above in so many respects that the same reference numerals have been used therein to denote identical or corresponding parts. Only the differences are discussed here in detail.

It should be noted first that the bow includes, in addition to the ribbon members 11 and 12 and the drawstrings 13, another pair of ribbons or strips 34, 36 preferably of narrower width and of a contrasting color or texture to that of the ribbon members 11 and 13. Instead of star-shaped decorations, the decorations 40 are heart-shaped, each having a heart-shaped peripheral cut 41 and a pair of webs 42, just like the webs 32.

Figure 8:
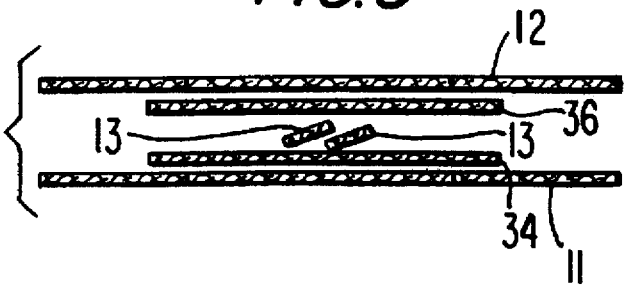
FIG. 8 shows a cross-section on an enlarged scale taken on the line 8—8 in FIG. 7.
Figure 7:
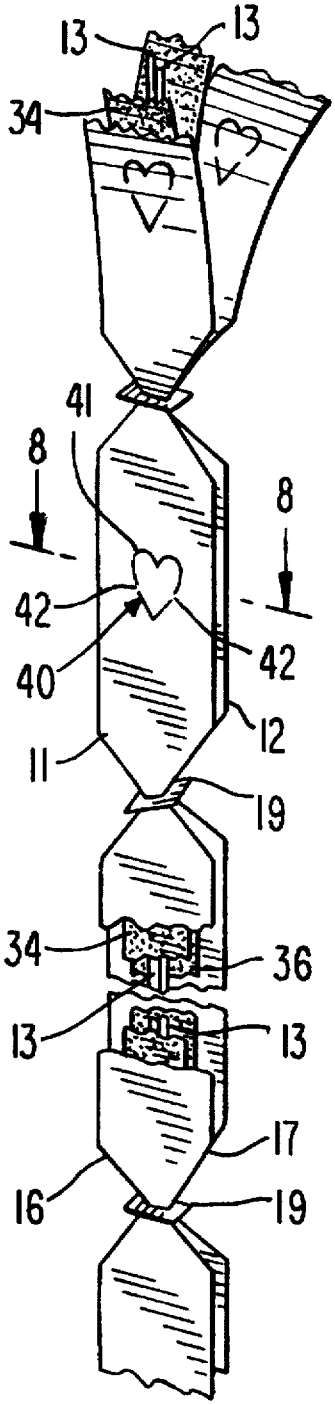
FIG. 7 shows a partially broken-away view analogous to FIG. 2, but of another embodiment of the invention.

As shown in FIG. 8, the contrast strips 34, 36 sandwich the drawstrings 13 and are, in turn, sandwiched by the ribbon members. The strips 34, 36 are provided with the same indentations 16 and 17 and neck regions 18 as are provided for the ribbon members.

Figure 9:
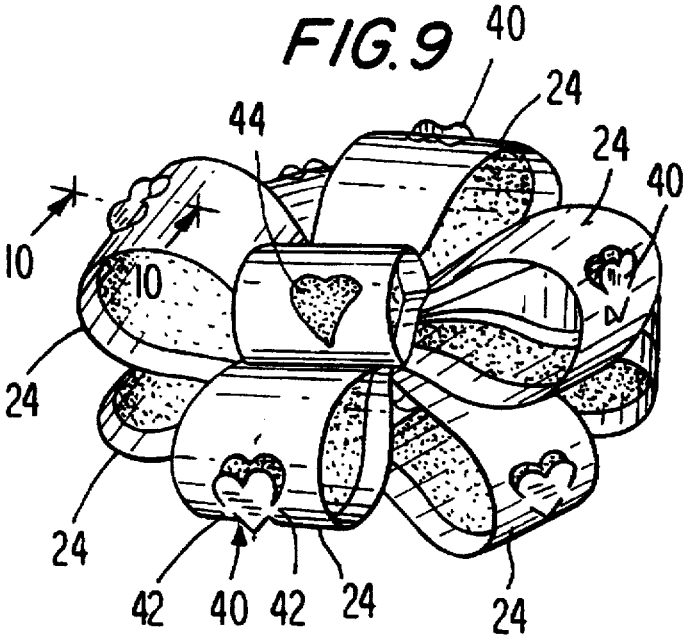
FIG. 9 shows a completed bow of the FIG. 7 embodiment.
Figure 10:
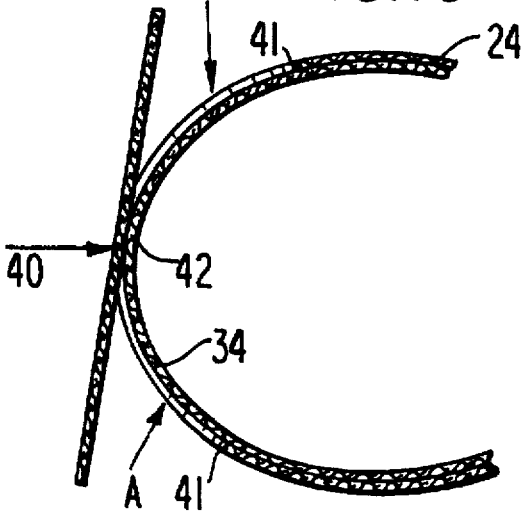
FIG. 10 shows a cross-section on an enlarged scale taken on the line 10—10 in FIG. 9.

The completed bow of FIG. 9 is formed just as described earlier for the embodiment of FIGS. 1–6. The heart-shaped decorations 40 are attached to the folded loop segments 24 at webs 42, while the remainder of the decorations 40 are spaced from the folded loop segments 24 and appear to project therefrom.

Now, the purpose of the contrast strips 34, 36 becomes clear. Due to the elevated position of at least the movable part of each decoration 40, the different color/texture of the underlying contrast strip 34, 36 is now visible through the space between each decoration 40 and the respective loop segment 24, as considered generally along the lines of sight depicted by the arrows A in FIG. 10, thereby creating a multi-textured, multi-colored visual effect.

Although the decorations 30, 40 have been illustrated as being star- or heart-shaped, it will be appreciated that any design is contemplated by this invention. Also, although the decorations 30, 40 have been described in connection with pull bows, they can also be implemented in pre-formed, multi-loop ribbon bows. Also, the webs 32, 42 need not be located at the lateral sides of each decoration, but can instead be located at different locations.

As described so far, each decoration 30, 40 is partially die-cut from the ribbon members. This invention also contemplates completely cutting a decorative cutout from the ribbon members. For example, a heart-or star-shaped cutout can be die-cut from the ribbon members. Such cutouts can replace one, or more, or all of the decorations 30, 40. An especially attractive embodiment is obtained when the contrast strips 34, 36 underlie the cutout. Reference numeral 44 in FIG. 9 shows an exemplary decorative cutout.

It will be understood that each of the elements described above, or two or more together, also may find a useful application in other types of constructions differing from the types described above.

While the invention has been illustrated and described as embodied in a bow with pop-out decorations, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention and, therefore, such adaptations should and are intended to be comprehended within the meaning and range of equivalence of the following claims.

What is claimed as new and desired to be protected by Letters Patent is set forth in the appended claims.

I claim:

1. A decorative bow, comprising:

a) a plurality of ribbon loops, at least one of the ribbon loops having a bight portion;

b) a pop-out decoration integral with, and partially separated from, the bight portion of said at least one of the ribbon loops, said decoration having a fixed part attached to the bight portion of said at least one ribbon loop, and a raised part spaced outwardly from the bight portion of said at least one ribbon loop.

2. The decorative bow as recited in claim 1; and further comprising additional pop-out decorations; and wherein each ribbon loop has a bight portion at which one of said decorations is provided.

3. The decorative bow as recited in claim 1, wherein said ribbon loops are equiangularly arranged around a central axis.

4. The decorative bow as recited in claim 1, wherein said fixed part includes a pair of webs spaced apart of each other at opposite lateral sides of said decoration, said webs being of one-piece with said at least one ribbon loop.

5. The decorative bow as recited in claim 4, wherein said at least one ribbon loop has a cut along its periphery that extends between said webs.

6. The decorative bow as recited in claim 1; and further comprising at least one contrast strip loop underneath said at least one ribbon loop and visible through a space bounded by said raised part and said at least one ribbon loop.

7. An adorning article transformable from an initial substantially flat state to a finished pom-pon-like bow state, comprising:

a) a first succession of first foldable ribbon segments interconnected by first neck segments;

b) a second succession of second foldable ribbon segments interconnected by second neck segments, said second ribbon segments overlying said first ribbon segments in said flat state;

c) means for connecting said first and second neck segments;

d) a drawstring connected to each succession and passing through said first and second neck segments with freedom of longitudinal movement, for folding the ribbon segments to form respective bight portions, and transforming the article from said flat state to said bow state; and e) a pop-out decoration integral with, and partially separated from, the bight portion of at least one of said ribbon segments, said decoration having a fixed part attached to the bight portion of said at least one ribbon segment, and a movable part spaced outwardly from bight portion of said at least one ribbon segment after folding thereof to the bow state.

8. The article as recited in claim 7, and further comprising additional pop-out decorations; and wherein each ribbon segment has a bight portion at which one of said decorations is provided.

9. The article as recited in claim 7, wherein said ribbon segments are equiangularly arranged around a central axis.

10. The article as recited in claim 7, wherein said fixed part includes a pair of webs spaced apart of each other at opposite lateral sides of said decoration, said webs being of one-piece with said at least one ribbon segment.

11. The article as recited in claim 10, wherein said at least one ribbon segment has a cut along its periphery that extends between said webs.

12. The article as recited in claim 7; and further comprising at least one contrast strip loop underneath said at least one ribbon segment and visible through a space bounded by said raised part and said at least one ribbon segment.

13. The article as recited in claim 7, wherein said decoration has a star-shaped pattern.

14. The article as recited in claim 7, wherein said decoration has a heart-shaped pattern.

15. The article as recited in claim 7, when said decoration and said at least one ribbon segment are generally co-planar in said flat state.

16. The article as recited in claim 7, wherein said at least one ribbon segment is constituted of a cuttable material, and wherein said decoration is die-cut from said at least one ribbon segment.

17. A decorative bow, comprising:

a) a plurality of ribbon loops, at least one of the ribbon loops having a bight portion; and b) a decorative cutout entirely separated from the bight portion of at least one of the ribbon loops.

18. The bow as recited in claim 17; and further comprising at least one contrast strip loop underneath said decorative cutout and visible through the decorative cutout.

* * * * *